US009656277B2

(12) United States Patent
Chirtu

(10) Patent No.: US 9,656,277 B2
(45) Date of Patent: May 23, 2017

(54) SWIMMING POOL WATER FILTRATION DEVICE

(71) Applicant: Stefan Chirtu, Andrezieux-Boutheon (FR)

(72) Inventor: Stefan Chirtu, Andrezieux-Boutheon (FR)

( * ) Notice: Subject to any disclaimer, the term of this patent is extended or adjusted under 35 U.S.C. 154(b) by 189 days.

(21) Appl. No.: 14/442,280

(22) PCT Filed: Nov. 12, 2013

(86) PCT No.: PCT/EP2013/073657
§ 371 (c)(1),
(2) Date: May 12, 2015

(87) PCT Pub. No.: WO2014/076098
PCT Pub. Date: May 22, 2014

(65) Prior Publication Data

US 2016/0271627 A1 Sep. 22, 2016

(30) Foreign Application Priority Data

Nov. 15, 2012 (FR) ..... 12 60890

(51) Int. Cl.

| | |
|---|---|
| ***B04C 5/04*** | (2006.01) |
| ***B04C 5/28*** | (2006.01) |
| ***B04C 9/00*** | (2006.01) |
| ***B04C 11/00*** | (2006.01) |
| ***E04H 4/12*** | (2006.01) |

(52) U.S. Cl.
CPC ..... *B04C 5/28* (2013.01); *B04C 5/04* (2013.01); *B04C 9/00* (2013.01); *B04C 11/00* (2013.01); *E04H 4/1245* (2013.01); *B04C 2009/005* (2013.01)

(58) Field of Classification Search
CPC .... B04C 5/04; B04C 5/28; B04C 9/00; B04C 11/00; B04C 2009/005; E04H 4/1245
See application file for complete search history.

(56) References Cited

FOREIGN PATENT DOCUMENTS

| | | |
|---|---|---|
| DE | 3539483 | 5/1987 |
| DE | 19849870 | 5/2000 |
| WO | 2004026486 | 4/2004 |
| WO | 2008155649 | 12/2008 |

OTHER PUBLICATIONS

The Translation of Written Opinion of the International Searching Authority for PCT/EP2013/073657, undated.*

* cited by examiner

*Primary Examiner* — David A Reifsnyder
(74) *Attorney, Agent, or Firm* — Occhiuti & Rohlicek LLP

(57) ABSTRACT

The invention relates to a device comprising at least three hydrocyclones and a pump. The pump comprises a centrifugal turbine, an electric motor capable of driving the turbine in rotation, a distributor capable of collecting the water recirculated by the turbine and introducing the water into the hydrocyclones. The distributor comprises at least one distribution channel for each hydrocyclone, each channel extending from an inlet orifice formed in a central circular housing to an outlet orifice formed in a wall of a hydrocyclone, and discharging into the hydrocyclone tangentially to the wall of this hydrocyclone. The centrifugal turbine is housed inside the central housing of the distributor, opposite the inlet orifices of the channels.

11 Claims, 3 Drawing Sheets

SWIMMING POOL WATER FILTRATION DEVICE

RELATED APPLICATIONS

This application is a U.S. National Stage of international application number PCT/EP2013/073657 filed May 12, 2013, which claims the benefit of the priority date of French Patent Application FR 1260890, filed May 15, 2012, the contents of which are herein incorporated by reference.

FIELD OF INVENTION

The invention relates to a swimming pool water filtration device.

BACKGROUND

Known filtration devices comprise:

at least two orifices, respectively a suctioning orifice for the water and a recirculating orifice for the filtered water, at least three hydrocyclones, each forming a cyclonic filter capable of separating the water from solid particles contained in this water, said hydrocyclones being arranged in a circle to delimit a substantially cylindrical internal space which extends along a central axis.

Hydrocyclones have a frustoconical shape and use centrifugal force to separate the solid particles from the water. "Frustoconical shape" is understood in this case as a shape having a frustoconical part and possibly a cylindrical part. The water is introduced into each hydrocyclone via a tangential inlet orifice which communicates a rotational movement thereto which produces the centrifugal force. This centrifugal force separates the solid particles from the water and forces the solid particles along the wall of the cone. The solid particles are then driven toward the bottom of the hydrocyclone. The water, having had the solid particles removed, rises to the top of the hydrocyclone.

Such devices are disclosed, for example, in the patent application WO2008155649. They require the use of a pump to introduce the water into the hydrocyclones, and thus pipes connecting the pump to the device. Frequently, the pump is placed in an equipment container or pool equipment room located in the vicinity of the swimming pool. The combined unit of the pump and the filtration device thus takes up a large amount of space. Moreover, pressure losses are considerable in the pipes connecting the pump to the device.

The prior art is also known from: DE 19849870A1, WO2004026486A1, DE3539483A1 and WO2008155649A1.

SUMMARY OF INVENTION

The invention aims to remedy these drawbacks by proposing a more compact device which does not require a pool equipment room and has fewer pressure losses.

The subject of the invention is, therefore, a filtration device according to claim 1.

The above device is a compact assembly and does not require a pool equipment room or container for the pump. Moreover, as the hydrocyclones are distributed in a circle about the centrifugal turbine, the pressure losses are reduced and identical for each of the hydrocyclones, which results in the use of a less powerful motor and therefore a reduced consumption of electricity.

The embodiments of this device may comprise one or more of the features of the dependent claims.

Said embodiments of the device also have the following advantages:

the presence of a housing, which groups together all of the elements necessary for the suctioning, filtration and evacuation of the water, makes it possible to have a very compact unit;

the solenoid valve between the collection end of a hydrocyclone and the tank makes it possible to recover automatically the solid particles in the tank in order to avoid the blockage of the hydrocyclones;

the solenoid valve located between the collection end and an evacuation orifice for the solid particles outside the housing makes it possible to limit the maintenance, as the evacuation of the solid particles is carried out automatically;

the presence of a particle sensor makes it possible to optimize the maintenance of the device by automatically opening the solenoid valve only when necessary, which facilitates the maintenance of the device;

a frustoconical conduit connecting the pump to the suctioning orifice creates a vortex which increases the flow of water entering the pump and the speed of the solid particles;

a centrifugal turbine comprising the features disclosed above and placed between the suctioning orifice and the hydrocyclones limits the pressure losses of the water circulating in the pump;

bringing together the two curves defining each distribution channel toward the outlet orifice permits an increase in the speed of the water circulating in each channel, and the water thus arrives at the inlet of the hydrocyclone at a higher speed than at the inlet of the distribution channel which therefore permits improved separation of the solid particles in the hydrocyclone;

distribution channels having the feature disclosed above relative to their tangent in the region of the inlet orifice contribute to the limitation of pressure losses during the circulation of water from the centrifugal turbine to the distributor, by minimizing the impact of the water against the walls of the channels;

the presence of at least seven hydrocyclones guarantees a separation of the solid particles which is sufficient for a high water flow;

the hydrocyclones which are all identical guarantee an identical separation of the solid particles from the water, to whichever hydrocyclone they are directed, and thus a homogeneity of the water recovered at the outlet of the hydrocyclones.

The invention will be understood more clearly by reading the following description which is provided solely by way of non-limiting example and made with reference to the drawings.

DETAILED DESCRIPTION

Figure 1:
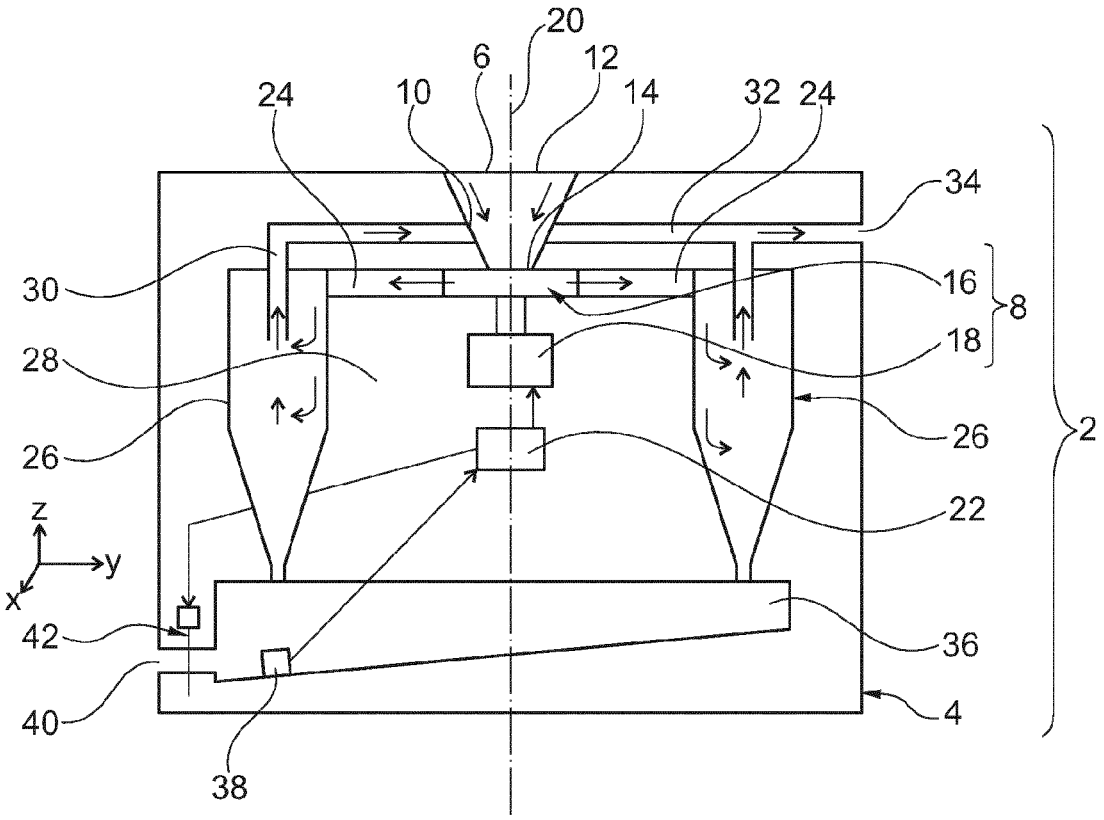
FIG. 1 is a basic sketch in vertical section of a swimming pool water filtration device.

In the figures, the same reference numerals are used to denote the same elements.

In the remainder of this description, the features and functions which are well known to the person skilled in the art are not described in detail.

FIG. 1 and the following figures are all oriented according to the same coordinates XYZ. The directions X and Y are in this case horizontal and the direction Z is the vertical direction. The terms "upper" and "lower", "above" and "below" used hereinafter extend in the direction Z.

FIG. 1 shows a filtration device 2. Arrows indicate the direction of circulation of water in the device.

The device 2 comprises in this case a watertight housing 4. For example, the housing is made of rigid plastics material or metal. The housing 4 in this case has a cylindrical shape of circular section. More specifically, the housing 4 comprises a cylinder which extends along the axis Z and two disks, respectively lower and upper, located in planes parallel to the plane XY at the ends of the cylinder. The cylinder and the upper and lower disks delimit an internal cavity which does not contain water. The housing 4 has the following dimensions: the diameter thereof is less than 80 cm, and preferably less than 60 cm, or 50 cm. The height of the housing 4 in the direction Z is less than 70 cm, and preferably less than 60 cm, or 50 cm.

The housing 4 comprises a suctioning orifice 6 for the water from the swimming pool. The orifice 6 in this case has a circular shape, the diameter thereof being greater than 3 cm, and preferably greater than 4 cm, or 5 cm. Typically, this diameter is less than 30 cm. The orifice 6 is located on the upper disk of the housing 4, in this case at its centre.

During use of the device 2, the housing 4 is immersed in the swimming pool, slightly below the free surface of the water, so that the orifice 6 is, for example, 3 or 4 cm below the surface of the water. The housing 4 may also be placed in the vicinity of the swimming pool, outside the water. In this case, the orifice 6 is in fluidic connection with the water of the swimming pool by means of a suction mouth, not shown. For example, this suction mouth is of similar shape to a recovery device or scum removal device, better known by the English term "skimmer".

The device 2 comprises a pump 8 which has the function of suctioning water from the swimming pool. The pump 8 is housed inside the housing 4. The pump 8 is in fluidic connection with the orifice 6 via a conduit 10. The conduit 10 in this case has a frustoconical shape and comprises two ends 12 and 14. The conduit 10 comprises a central axis oriented along the axis Z. The two ends 12 and 14 extend in planes parallel to the plane XY and have circular sections of different diameters. The end 12 has a diameter equal to that of the orifice 6 and is directly connected to the orifice 6. The end 14 has a diameter which is smaller than that of the end 12 and is directly connected to the pump 8. The frustoconical shape of the conduit thus arranged creates a vortex in the conduit which increases the flow of water entering the pump 8.

The pump 8 comprises a centrifugal turbine 16 and a motor 18. The motor 18 is a low voltage electric motor coupled to the turbine 16 so as to drive the turbine 16 in rotation. The motor 18 is powered by an electrical power supply cord, not shown in the figure, which connects the motor 18 to an electrical supply outside the housing 4. For example, the power of the motor is less than 2 kW or preferably less than 1.5 kW. The start-up and stoppage of the motor 18 are controlled here by an electronic control unit 22, housed inside the housing 4. When the motor 8 is in operation, its speed of rotation is constant in this case. The centrifugal turbine 16 comprises a vertical axis of rotation 20, merged here with the generatrix of the cylinder of the housing 4. The motor is placed along the axis 20 below the turbine 16. The end 14 of the conduit 10 is in fluidic connection with the turbine 16. The turbine 16 suctions the water which is discharged from the conduit 10 vertically and recirculates the water, due to its rotational movement, in a horizontal plane. The centrifugal turbine 16 in this case has the shape of a wheel. It is described in more detail with reference to FIGS. 2 and 3.

The water recirculated by the turbine 16 is discharged into a distributor 24. The distributor 24 comprises a plurality of distribution channels extending in a horizontal plane. The distributor 24 and its association with the turbine 16 are described in more detail with reference to FIGS. 4 and 5.

The distribution channels of the distributor 24 each discharge into a hydrocyclone 26, tangentially to the wall of the hydrocyclone. The device 2 comprises in this case seven hydrocyclones 26 which are all identical. The hydrocyclones 26 are housed inside the housing 4. The hydrocyclones 26 extend substantially along a vertical axis and are arranged in a circle around the turbine 16. The upper ends of the hydrocyclones 26 are located in the same horizontal plane as the distributor 24. The hydrocyclones 26 delimit a substantially cylindrical internal space 28 which extends along a central vertical axis merged with the axis of rotation 20. The pump 8 is housed inside the space 28. The shape and the operation of the hydrocyclones 26 are described in more detail with reference to FIG. 6.

The water separated from its solid particles in the hydrocyclones 26 is recirculated in the upper part of the hydrocyclones in the region of outlet nozzles 30 which are all identical. Each hydrocyclone 26 comprises a nozzle 30. All of the nozzles 30 discharge into a conduit 32 connected to a recirculation orifice 34 for filtered water. The orifice 34 is arranged in the wall of the housing 4 and permits the filtered water to be recirculated in the swimming pool. In this case, the orifice 34 is located on the cylindrical part of the housing 4, at more than 10 cm, from the upper disk of the housing 4.

The device 2 also comprises a tank 36. The tank 36 collects the solid particles separated from the water by the hydrocyclones 26. The tank is located below the hydrocyclones 26 such that the lower part of each hydrocyclone 26 opens into the tank 36. The tank 36 has a circular shape which may be recessed at its centre. The tank 36 comprises in this case a sensor 38 for solid particles. For example, the sensor 38 is a piezoelectric sensor. The tank 36 also comprises an evacuation orifice 40 for particles outside the housing 4. For example, the evacuation orifice 40 is connected as a whole to the drain by a channel, not shown, or to a soakaway. The bottom of the tank 36 in this case slopes as far as the orifice 40 in order to facilitate the evacuation of solid particles by gravity. The device 2 comprises a controllable solenoid valve 42 arranged between the tank 36 and the evacuation orifice 40. The solenoid valve 42 comprises a flap valve and an actuator capable of actuating the flap valve. For example, this actuator is an electromagnetic magnet such that the solenoid valve is an electromagnetic valve. The flap valve is capable of being displaced between:

an open position in which the solid particles are able to circulate from the tank 36 to the evacuation orifice 40 and, alternately, a closed position in which the solid particles are not able to circulate from the tank 36 to the evacuation orifice 40.

The actuator displaces the flap valve, in response to a command from the electronic unit 22, from its open position into its closed position or vice versa.

The sensor 38 transmits a measurement signal, which represents the quantity of solid particles present in the tank 36, to the electronic unit 22. The unit 22 automatically controls an opening of the solenoid valve 42 if the transmitted measurement signal exceeds a predetermined threshold which has been programmed.

Figure 2:
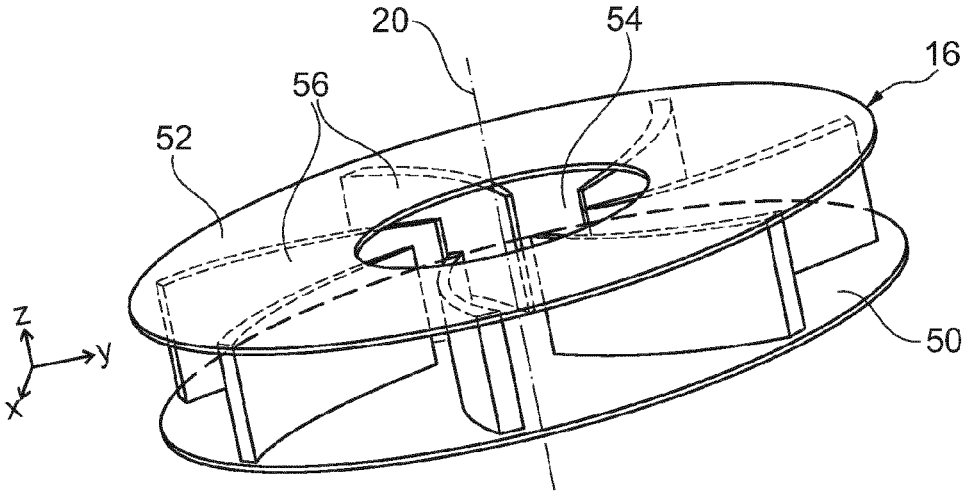
FIG. 2 is a perspective view of a centrifugal turbine of the device of FIG. 1.

FIG. 2 shows a perspective view of the centrifugal turbine 16. The turbine 16 comprises a solid lower disk 50, centred on the axis of rotation 20. The disk 50 extends in a horizontal plane. The diameter of the disk 50 is less than 12 cm, preferably less than 10 cm, or even 9 cm. In this embodiment, the turbine 16 also comprises an upper disk 52. The disk 52 has a diameter which is identical to that of the disk 50 and extends in a plane which is also horizontal. The disk 52 comprises a circular orifice 54 at its centre. The orifice 54 is arranged opposite and in the vicinity of the end 14 of the conduit 10.

Figure 3:
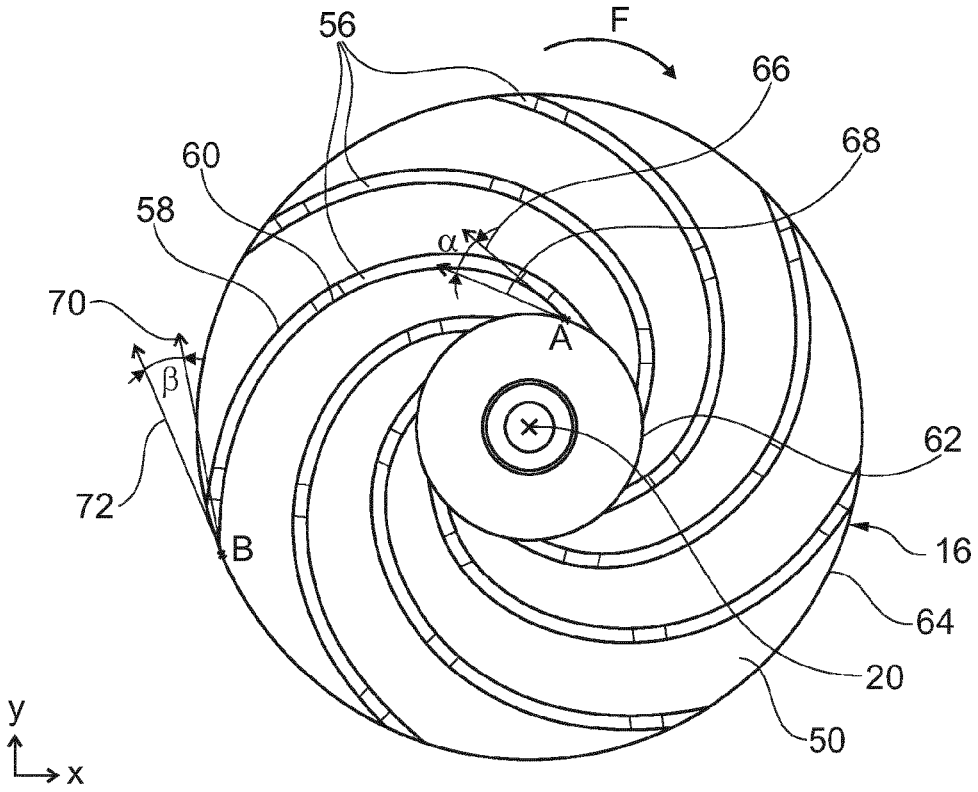
FIG. 3 is a schematic view in horizontal section of the turbine of FIG. 2.

The turbine 16 comprises in this case seven blades 56 arranged between the two disks 50 and 52. Here the blades 56 are all identical and spaced apart uniformly from one another. In FIG. 3, said blades are visible by transparency through the disk 52. The height of the blades 56 measured along the axis Z is equal to the distance which separates the two disks 50 and 52. Here, for example, the height of the blades is between 12 and 20 mm and preferably between 15 and 18 mm. The height of the turbine 16 along the axis Z corresponds to the height of the blades, added to the thickness along Z of the two disks 50 and 52.

FIG. 3 shows in more detail the blades 56 in section along a horizontal plane. An arrow F indicates the direction of rotation of the turbine 16, here in the clockwise direction. Each blade 56 extends along a non-rectilinear curve, without a point of inflection. Taking into account the thickness of the blades 56, each blade 56 is delimited by two parallel non-rectilinear curves 58 and 60, without a point of inflection. Each curve 58, 60 extends from a point A which is located on an internal circle 62 centred on the axis 20 to a point B which is located on an external circle 64 centred on the same axis. Here the circle 64 merges with the external circle delimiting the disk 50. The circle 62 has a diameter greater than or equal to that of the orifice 54.

The tangents of the curves 58 and 60 at the points of intersection respectively A and B with the circles 62 and 64 comprise the following features. To simplify the figure, only the tangents to a curve 60 at A and B are shown.

At A, the angle $\alpha$ between the tangent vector 66 to the curve 60 and the tangent vector 68 to the circle 62, oriented in the reverse direction of rotation of the turbine 16, is between 0° and 50°, and preferably between 0° and 40°. Here for example, the angle $\alpha$ is approximately equal to 25°. The vector 66 is oriented in the direction of flow of the water.

At B, the angle $\beta$ between the tangent vector 70 to the curve 60 and the tangent vector 72 to the circle 64 is between 0° and 45°, and preferably between 0° and 30°, or between 0° and 20°. The two vectors 70 and 72 are oriented in the direction of rotation of the turbine 16.

Figure 4:
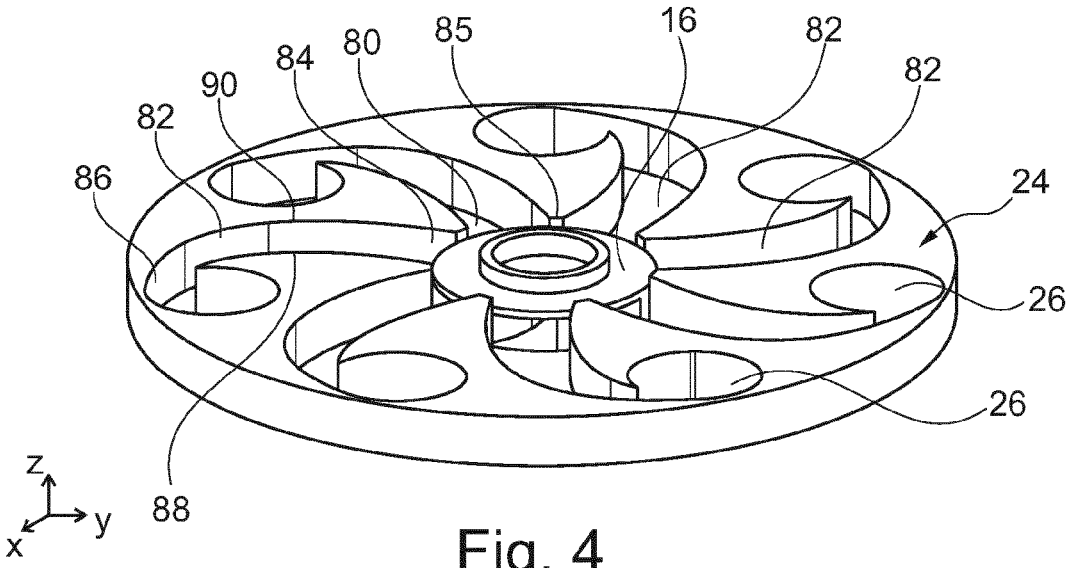
FIG. 4 is a schematic illustration in perspective of a distributor of the device of FIG. 1.

FIG. 4 shows the distributor 24 in more detail.

The distributor 24 has the functions of guiding and accelerating the water to the hydrocyclones 26, whilst minimizing the pressure losses, and introducing water tangentially to the wall of the hydrocyclones 26 at a maximum speed. The distributor 24 has a circular shape which extends in a horizontal plane, and the height thereof in the direction Z is equal to the height of the turbine 16. The distributor 24 comprises a circular central housing 80 over its entire height. The turbine 16 is housed inside the housing 80. The diameter of the housing 80 is slightly greater than that of the turbine 16. For example, the clearance between the periphery of the disks 50 and 52 and the vertical wall of the housing 80 is less than 2 mm or 1 mm. The distributor 24 is fixed.

The diameter of the distributor 24 is such that the distributor 24 encloses the assembly of the upper parts of the hydrocyclones 26 arranged in a circle about the axis 20. To minimize the space required, the external circle delimiting the distributor 24 is located at less than 5 cm and preferably at less than 3 cm, or 2 cm from the point of the wall of the hydrocyclones 26 furthest away from the axis 20. The distributor 24 comprises a circular orifice for each hydrocyclone 26 so that the upper part of each hydrocyclone 26 is housed inside the corresponding orifice.

The distributor 24 comprises a distribution channel 82 for each hydrocyclone 26. The distribution channels 82 here are all identical and distributed uniformly over the periphery of the housing 80 and thus seven in number. A single channel 82 is described below.

The distributor 24 collects the water recirculated by the turbine 16 in the distribution channels 82 to introduce the water inside each hydrocyclone 26 tangentially to the wall of the hydrocyclone 26. Each channel 82 comprises an inlet orifice 84 formed in the housing 80 and an outlet orifice 86 in the wall of a hydrocyclone 26. Two consecutive inlet orifices 84 are separated in a horizontal plane by a circular arc 85 delimiting the housing 80. The angular value of the circular arcs 85, which are all identical, is preferably less than 20°, or even 5°. The inlet orifices 84 have a rectangular shape.

Each channel 82 extends in a horizontal plane and the cross section of each channel 82 in this horizontal plane is delimited on both sides by two curves 88 and 90. Said curves 88, 90 correspond to the intersection between the vertical walls of the channel 82 and the horizontal plane. The two curves 88 and 90 are non-rectilinear, without a point of inflection, in order to limit pressure losses of the water circulating inside the channel 82. In this embodiment, the two curves 88 and 90 progressively approach one another when passing from the orifice 84 toward the orifice 86. Thus, the speed of the water at the outlet of the channel 82 is greater than the speed of the water at the inlet of the channel 82. This makes it possible to increase the speed of the water upstream of the inlet in the hydrocyclone 26. The centrifugal force in the hydrocyclone 26 is thus greater and the separation of the solid particles of better quality. The walls of the channel 82 are smooth in order to limit the friction of water against the walls and to minimize the pressure losses.

Each channel 82 discharges into a hydrocyclone 26 in the region of the orifice 86. The curve 90 is tangent to the wall of the hydrocyclone 26 in the region of the orifice 86.

Figure 5:
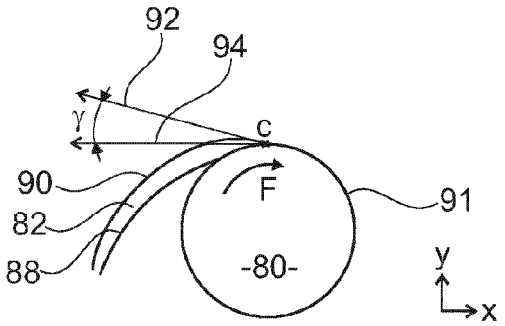
FIG. 5 is a schematic illustration of a distribution channel in the region of the inlet orifice of the distributor of FIG. 4.

The intersection of the curve 90 with the vertical wall of the housing 80 is shown in more detail in FIG. 5. In this figure, the periphery of the housing 80 is shown by a circle 91. An arrow F indicates the direction of rotation of the turbine 16 inside the central housing 80, here in the clockwise direction. The curve 90 intersects the circle 91 at a point C. The angle $\gamma$ between a tangent vector 92 to the curve 90 in the region of the point C and a tangent vector 94 at C to the circle 91 is between 0° and 45°, preferably between 0° and 30°, or between 0° and 20°. Preferably, the angle $\gamma$ is selected to be equal to the angle $\beta$ (FIG. 3) by +/−20% or 10%. The two vectors 92 and 94 are oriented in the direction of flow of the water.

Figure 6:
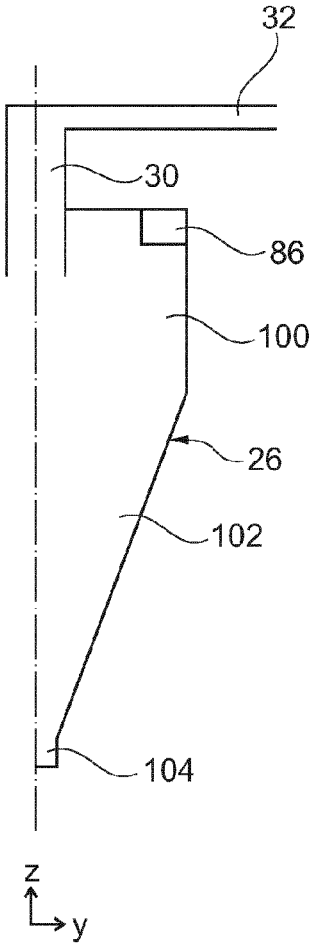
FIG. 6 is a schematic illustration in vertical section of half of a hydrocyclone of the device of FIG. 1.

FIG. 6 shows in section half of the hydrocyclone 26. As the hydrocyclones 26 are symmetrical relative to a vertical axis only half of a hydrocyclone 26 is thus shown.

The hydrocyclone 26 conventionally comprises an upper cylindrical part 100 of circular section and, below, a cone 102, the section thereof in a horizontal plane reducing as it moves away from the upper part 100. A collection end 104 for solid particles separated from the water is located below the cone 102. This end 104 is cylindrical of circular section, equal to the section of the lower end of the cone 102. The hydrocyclone 26 comprises in the part 100 an inlet orifice for water which corresponds to the outlet orifice 86 of the distribution channel 82, which discharges tangentially into the interior of this hydrocyclone 26. The orifice 86 has a rectangular section in a vertical plane. Here the orifice 86 adjoins the upper end of the hydrocyclone 26. The hydrocyclone 26 also comprises an outlet nozzle 30 via which the filtered water is discharged. The nozzle 30 is located at the centre of the cylindrical part 100 and has a circular section in a horizontal plane. One end of the nozzle 30 is located inside the cylindrical part 100. The other end is in fluidic connection with the conduit 32.

The water is introduced into the hydrocyclone 26 via the tangential inlet orifice 86, which communicates a rotational movement thereto which produces the centrifugal force. This centrifugal force separates the water from particles which are more dense than water. The particles which are more dense than water fall into the collection end 104. The filtered water, having had its solid particles removed, rises via the outlet nozzle 30.

Such a filtration device 2 permits the filtration of particles, the density thereof, relative to pure water at 4° C., being greater than or equal to 2 and the size thereof being greater than or equal to 20 μm or 10 μm or 5 μm. The precise dimensions of a hydrocyclone permitting these results to be achieved may be derived from the teaching and data contained, for example, in the following articles:

Rietma, K. 1961, "Performance and design of hydrocyclones". Parts I to IV. Chem. Eng. Sci. Vol. 15 pp 298-325, and Bradley, D. & Pulling, D. J. 1959, "Flow patterns in the hydraulic cyclone and their interpretation in terms of performance". Trans. Inst. Chem. Eng. Vol. 37 pp 34-45.

Figure 7:
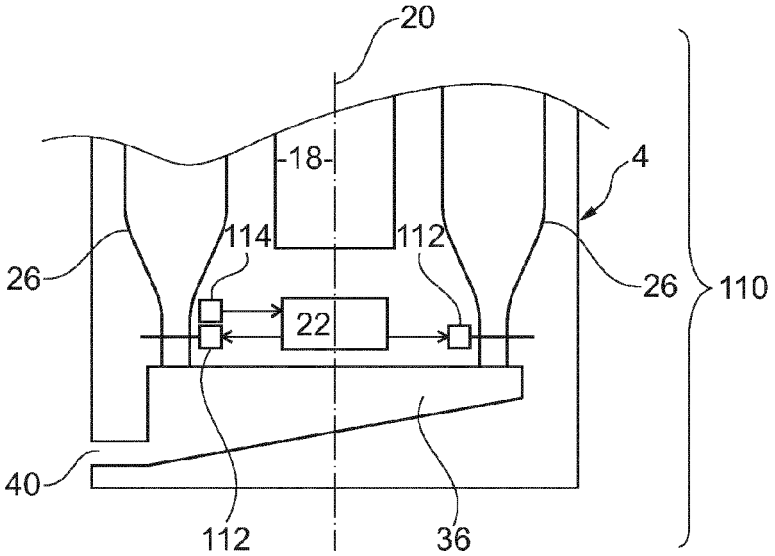
FIG. 7 is a basic sketch in vertical section of a further embodiment of a swimming pool water filtration device.

FIG. 7 shows a further filtration device 110. The device 110 is identical to the device 2 with the exception of the solenoid valve 42 and the sensor 38. The device 110 comprises a solenoid valve 112 for each hydrocyclone 26. Each solenoid valve 112 is arranged between the collection end 104 of the hydrocyclone 26 and the tank 36. The flap valve of the solenoid valve 112 is capable of being displaced between an open position in which the solid particles are able to circulate from the collection end 104 to the tank 36 and, alternately, a closed position in which the solid particles are not able to circulate from the collection end 104 to the tank 36.

For example, the solenoid valve 112 is identical to the solenoid valve 42.

The device 110 comprises in this case a sensor 114 placed outside a hydrocyclone 26 and against a wall of the collection end 104. The sensor 114 transmits a measurement signal, which represents the quantity of solid particles present in the collection end 104, to the electronic unit 22. Here the sensor 114 is an optical sensor. The wall of the collection end 104 is transparent to light.

Numerous other embodiments are possible. For example, it is possible for the number of hydrocyclones to be different from seven. However, the number of hydrocyclones is greater than three or four and preferably greater than eight or ten.

It is possible for the hydrocyclones not to be all identical. For example, one hydrocyclone is smaller than the others.

The number of blades of the turbine may be different from the number of hydrocyclones. For example, the number of blades is less than the number of hydrocyclones. The number of blades may also be greater than the number of hydrocyclones.

The number of distribution channels of the distributor may be greater than the number of hydrocyclones. In this case, more than one distribution channel discharges into the same hydrocyclone.

The centrifugal turbine may be different from a wheel. For example it is replaced by a helix.

The filtration device may comprise a screen, placed upstream of the pump, which ensures pre-filtration of the largest solid particles.

The circle 64 of the turbine may have a diameter which is less than that of the disk 50. In this case, the blades do not reach the contour of the disk 50.

It is possible for the turbine not to have an upper disk 52.

The blades 56 may be in three dimensions, i.e. the curves along which each blade 56 extends in different horizontal sectional planes are different.

The electronic unit 22 may be located outside the housing 4.

It is possible for the tank 36 not to be connected as a whole to the drain or to a soakaway. In this case, the device requires regular manual emptying of the tank 36.

The device 110 may comprise a sensor 114 for each collection end 104. The electronic unit 22 may control each solenoid valve 112 independently of the others, or even all of the solenoid valves 112 at the same time.

As a variant, the solenoid valve 42 or 112 is replaced by a manual valve. In a further variant, the solenoid valves 42 and 112 are omitted.

The actuator of the solenoid valves 42 or 112 may be a motor.

The sensor 38 may be replaced by an optical sensor placed at the side of the tank 36. In this case, the wall of the tank 36 has to be transparent to light. Similarly, the sensor 114 may be piezoelectric sensor placed in the collection end 104. As a variant, the sensor 38 or 114 is omitted. In this case, the unit 22 is programmed to control the opening of the solenoid valves 42 or 112 at regular intervals.

The device may comprise one tank for each hydrocyclone and not just one common tank. As a variant, the tank 36 is omitted. In this case, the collection ends 104 are each directly in fluidic communication with the orifice 40.

The hydrocyclones may be inclined relative to a vertical axis.

It is possible for the housing not to be cylindrical. For example, it may have a cuboidal shape.

The speed of the motor 18 may be variable.

It is possible for the assembly of the devices 2 or 110 not to be placed in a housing 4. In this case, each element of the device is itself watertight.

The electronic control unit 22 may be placed inside or outside the housing.

The angle γ between 0° and 45° may also be the angle between the tangent to the curve 88 and the tangent to the circle 91, in the region of the point of intersection of the curve 88 and the circle 91. This property of the angle γ may also relate to the two curves 88 and 90.

The solenoid valves 42, 112 and the unit 22 for controlling said solenoid valves may be used irrespective of whether the pump 8 is present or not present inside the housing 4.

The invention claimed is:

1. A swimming pool water filtration device, comprising:

at least two orifices, respectively a suctioning orifice for water and a recirculating orifice for filtered water, at least three hydrocyclones, each forming a cyclonic filter capable of separating the water from solid particles contained in the water, said hydrocyclones being arranged in a circle to delimit a substantially cylindrical internal space which extends along a central axis, a pump in fluidic connection with the suctioning orifice via a conduit, and a distributor capable of collecting the water recirculated by the pump and introducing the water into the hydrocyclones, said distributor comprising at least one distribution channel for each hydrocyclone, each channel extending in a plane perpendicular to the central axis, from an inlet orifice formed in a central circular housing to an outlet orifice formed in a wall of a hydrocyclone, each channel discharging into the hydrocyclone tangentially to the wall of this hydrocyclone, wherein the pump is housed inside the substantially cylindrical space, said pump comprising:

a centrifugal turbine comprising an axis of rotation merged with the central axis, capable of removing water from the swimming pool in a direction parallel to the axis of rotation and recirculating said water in directions perpendicular to the axis of rotation, the centrifugal turbine being housed inside the central housing of the distributor, in front of the inlet orifices of the channels, and an electric motor capable of driving the turbine in rotation.

2. The device according to claim 1, further comprising a watertight housing, inside which are housed the hydrocyclones, the pump and the distributor, said housing comprising at least the two orifices, respectively the suctioning orifice for the water and the recirculating orifice for the filtered water.

3. The device according to claim 1, in which each hydrocyclone comprises a collection end for solid particles separated from the water and the device comprises:

at least one tank capable of collecting the solid particles separated from the water by the hydrocyclones, in fluidic connection with at least one collection end, at least one controllable solenoid valve arranged between at least one of said collection ends and the tank, said solenoid valve being capable of being displaced in response to a command, between:

an open position in which the solid particles are able to circulate from the collection end to the tank and, alternately, a closed position in which the solid particles are not able to circulate from the collection end to the tank, an electronic unit for automatic control of said at least one solenoid valve.

4. The device according to claim 3, further comprising:

at least one sensor for solid particles, capable of transmitting a measurement signal, which represents the quantity of solid particles present in the collection end of a hydrocyclone or in the tank, to the electronic unit, and said electronic unit is programmed to control automatically an opening of the solenoid valve in response to said measurement signal passing a predetermined threshold.

5. The device according to claim 1, in which each hydrocyclone comprises a collection end for solid particles separated from the water and the device comprises:

at least one controllable solenoid valve arranged between said collection end and an evacuation orifice for the solid particles outside the housing, said solenoid valve being capable of being displaced in response to a command, between:

an open position in which the solid particles are able to circulate via the evacuation orifice and, alternately a closed position in which the solid particles are not able to circulate via the evacuation orifice, an electronic unit for automatically controlling said at least one solenoid valve.

6. The device according to claim 1, in which the conduit connecting the pump to the suctioning orifice is a frusto-conical conduit comprising two ends of different sections, the end having the largest section, being directly connected to the suctioning orifice.

7. The device according to claim 1, in which the centrifugal turbine comprises:

a solid disk extending in a plane perpendicular to the axis of rotation of the turbine, at least three identical blades spaced apart uniformly and arranged on the disk, the cross section of each blade in a transverse plane perpendicular to the axis of rotation extending along a non-rectilinear curve, without a point of inflection, said curve extending from an internal circle centered on the axis of rotation of the turbine, to an external circle centered on the same axis, and such that:

at the point of intersection with the internal circle, the angle between the tangent to this curve and the tangent to the internal circle is between 0° and 50°, and at the point of intersection with the external circle the angle between the tangent to this curve and the tangent to the external circle is between 0° and 45°.

8. The device according to claim 1, in which the cross section of each distribution channel in a transverse plane perpendicular to the axis of rotation is delimited on both sides by two non-rectilinear curves, without a point of inflection, said two curves approaching one another progressively when passing from the inlet orifice to the outlet orifice.

9. The device according to claim 1, in which:

the cross section of each distribution channel in a transverse plane perpendicular to the axis of rotation is delimited on both sides by two non-rectilinear curves, without a point of inflection, and the angle in the region of the inlet orifice between the tangent to one of the two curves delimiting each channel and the tangent to the central circular housing is between 0° and 45°.

10. The device according to claim 1, further comprising at least seven hydrocyclones.

11. The Device according to claim 1, in which the hydrocyclones are all identical.

* * * * *